US006816688B2

(12) United States Patent
Takano

(10) Patent No.: US 6,816,688 B2
(45) Date of Patent: Nov. 9, 2004

(54) IMAGE FORMING APPARATUS

(75) Inventor: Kenji Takano, Tokyo-To (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/032,614

(22) Filed: Jan. 2, 2002

(65) Prior Publication Data

US 2003/0123891 A1 Jul. 3, 2003

(51) Int. Cl.[7] ..... G03G 15/20

(52) U.S. Cl. ..... 399/69; 219/216; 219/470; 219/619; 399/33; 399/328; 399/334

(58) Field of Search ..... 399/69, 33, 67, 399/328, 329, 330, 334; 219/216, 470, 619, 671

(56) References Cited

U.S. PATENT DOCUMENTS

| | | | | |
|---|---|---|---|---|
| 4,585,325 A | * | 4/1986 | Euler | 399/69 |
| 5,526,103 A | * | 6/1996 | Kato et al. | 399/328 |
| 5,754,917 A | * | 5/1998 | Fromm et al. | 399/33 |
| 6,292,648 B1 | * | 9/2001 | Higaya et al. | 219/216 X |
| 6,336,027 B1 | * | 1/2002 | Sakai et al. | 399/328 |
| 6,405,014 B2 | | 6/2002 | Takano et al. | |
| 6,427,056 B1 | | 7/2002 | Kawano et al. | |
| 6,463,252 B2 | * | 10/2002 | Omoto et al. | 399/330 |
| 2002/0003969 A1 | | 1/2002 | Kimoto et al. | |
| 2002/0027134 A1 | | 3/2002 | Nakayama et al. | |
| 2002/0030050 A1 | | 3/2002 | Takagi et al. | |
| 2002/0031360 A1 | | 3/2002 | Umezawa et al. | |
| 2002/0031365 A1 | | 3/2002 | Konouchi et al. | |

FOREIGN PATENT DOCUMENTS

| | | | |
|---|---|---|---|
| JP | 08-063022 | * | 3/1996 |
| JP | 09-306651 A | | 11/1997 |

* cited by examiner

*Primary Examiner*—Sophia S. Chen
(74) *Attorney, Agent, or Firm*—Foley & Lardner LLP

(57) ABSTRACT

An image forming apparatus is provided with a pressing roller for pressing a sheet at the time of a fixing operation; a fixing roller having a hollow portion, facing the pressing roller, rising in temperature by being heated, and fixing a developer to the sheet by sandwiching the sheet between the fixing roller and the pressing roller; and induction heating coils including a center-section coil and an end-section coil, and arranged inside the fixing roller in an axial direction so as to leave a space between the center-section coil and the end-section coil, the space being adjusted so that the temperature of one surface of the fixing roller, the one surface opposing the space, is not higher than the temperatures of the other surface of the fixing roller, the other surface opposing central portions of the coils.

29 Claims, 3 Drawing Sheets

IMAGE FORMING APPARATUS

FIELD OF THE INVENTION

The present invention relates to an image forming apparatus including a fixing device of induction-heating type, and more particularly, to an image forming apparatus including a fixing device, in which, for example, a fixing roller contains a plurality of coils.

BACKGROUND OF THE INVENTION

There is a type of image forming apparatus that includes a fixing device of a type utilizing induction heating performed by one induction heating coil (coil) to heat up a fixing roller (heating roller). In order to prevent the heating roller from being abnormally overheated, like at the time of a failure etc. of the image forming apparatus, an overheating prevention valve (overheating prevention element), such as a thermostat, a thermal fuse, etc., is provided near the surface of the heating roller. In a conventional induction-heating type of fixing device whose heating roller contains one coil therein, the single coil is provided to a central portion (a part of the surface of the heating roller substantially at the midpoint in the longitudinal direction of the heating roller) where the surface temperature becomes the highest when an abnormal condition occurs.

There is another type of image forming apparatus including a fixing device of a type containing a plurality of lamps serving as heat sources inside its heating roller. In such an image forming apparatus, the highest-temperature portions of the heating roller are the portions on the surface corresponding to the positions of the lamps. Accordingly, one overheating prevention valve is provided to one of these portions, which can be monitored.

In a fixing device of the type containing only one coil in its heating roller, sometimes it happens that there is a considerable difference in surface temperature between the central portion and the end portions of the heating roller. That is, in the warming-up mode (when no paper is fed), the temperature rise rate of the central portion of the heating roller is rather high. On the other hand, in the printing mode (when paper is fed), since paper being fed removes heat from the heating roller, the temperature rise rate of the end portions, which are the areas not associated with the printing operation since they do not contact the paper, becomes relatively high. Accordingly, in order to prevent the rise in temperature at the end portions of the heating roller in the printing mode, air cooling control, etc., using a fan (end portion cooling fan) or the like is carried out. Of course, the end portion cooling fan is not activated in the warming-up mode.

As described above, in the warming-up mode, the temperature at the central portion of the heating roller rises. Accordingly, it is natural that if the oscillation of coil continues after the temperature of the heating roller reaches the fixing temperature due to the occurrence of an abnormal condition of the thermistor, etc., and the heating roller is continuously heated, the surface temperature of the central portion becomes highest. Therefore, conventionally, one overheating prevention valve was provided to the central portion.

On the other hand, in the printing mode, the coil is alternately oscillated and stopped in order to maintain the temperature of the heating roller in a fixable range. The paper being fed removes heat from the portion of the surface of the heating roller contacting the paper, resulting in that the temperature of the end portions that do not contact the paper becomes relatively high. However, because of the air-cooling control performed by the end portion cooling fan, the temperatures of the end portions and the central portion become substantially the same. In such a state, if an abnormal condition occurs to the ON/OFF control of the coil, resulting in that the heating roller is continuously heated, i.e., the coil is continuously oscillated without stopping, the temperature of the central portion becomes the highest. From this standpoint, it is sufficient that one overheating prevention valve is provided at the central portion.

In such a fixing device, coils used exclusively for the end portions may be newly provided inside the heating roller to achieve heating by a plurality of coils. In such a case, overheating prevention devices may be provided in a one-to-one relationship with the coils.

With such an arrangement, the overheating prevention devices are expected to monitor the highest temperature portions of the heating roller. However, sometimes it may happen that the portions between the coils have the highest temperature. In such a case, the above arrangement is no longer the optimum coil arrangement. The reason is as follows. The overheating prevention devices are provided for the purpose of preventing overheating of the heating roller at the time of the occurrence of an abnormal condition; for this purpose, the overheating prevention devices must surely monitor the highest temperature portions of the heating roller in every case; however, in the above arrangement, no overheating prevention valve is provided at the most overheated portions of the heating roller.

SUMMARY OF THE INVENTION

The present invention is proposed in view of the above-described problems, and an object of the present invention is to provide an image forming apparatus including a plurality of induction heating coils therein, in which the surface temperature of a fixing roller can be properly monitored with the minimum number of overheating prevention devices.

An image forming apparatus according to the present invention includes: a pressing roller for pressing a sheet at the time of a fixing operation; a fixing roller having a hollow portion, facing said pressing roller, rising in temperature by being heated, and fixing a developer to the sheet by sandwiching the sheet between said fixing roller and said pressing roller; and induction heating coils including a center-section coil and an end-section coil, and arranged inside said fixing roller in an axial direction so as to leave a space between the center-section coil and the end-section coil, the space being adjusted so that the temperature of one surface of said fixing roller, said one surface opposing the space, is not higher than the temperatures of the other surface of said fixing roller, said other surface opposing central portions of the coils.

DESCRIPTION OF THE PREFERRED EMBODIMENTS

Hereinafter, an embodiment of the present invention will be described with reference to the accompanying drawings.

First, the characteristic features of this embodiment will be briefly described.

In a heating roller containing a plurality of coils in its hollow portion, if the intervals between coils are changed, the surface temperatures of the portions corresponding to the spaces between the coils and the surface temperatures of the portions corresponding to the central portions of the coils can be changed. The present inventor has obtained this knowledge by his own efforts, and the present invention was made based on this knowledge. Thus, other inventors cannot arrive at the present invention. The following explains the present invention in detail.

In this embodiment, three coils for heating the heating roller are arranged in the longitudinal direction inside the heating roller of the fixing device. The positions of the coils are adjusted such that the coils maintain predetermined intervals. That is, the surface temperature of the heating roller is made uniform all around by adjusting the spaces between the coils. Specifically, the surface temperature is controlled such that the temperatures of the portions of the surface of the heating roller corresponding to the spaces between the coils do not exceed the temperatures of the portions corresponding to the central portions of the coils. In other words, the peak surface temperature of the heating roller is the temperature of the portion of the surface of the heating roller corresponding to the central portion of any one of the coils. The overheating prevention devices are provided only at such peak portions. Thus, in this embodiment, because the peak temperature portion of the heating roller is a portion of the surface of the heating roller corresponding to the central portion of any one of the coils, it is possible to properly monitor the heating roller with the minimum number of overheating prevention devices.

Hereinafter, the embodiment of the present invention will be described in detail.

Figure 1:
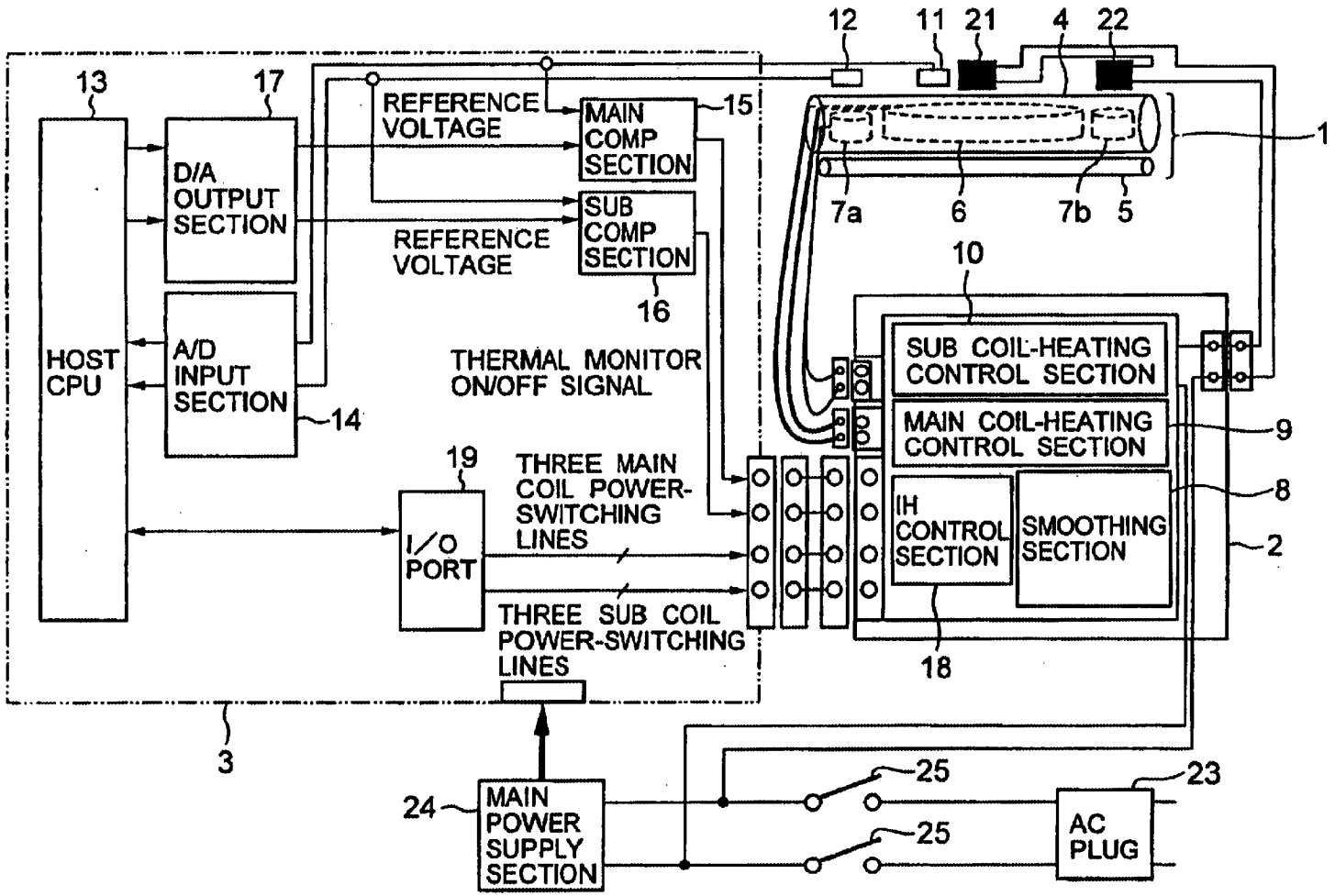
FIG. 1 is a control block diagram showing the configurations of a fixing device and its periphery circuits in an image forming apparatus in an embodiment of the present invention.

FIG. 1 is a control block diagram showing the configurations of a fixing device and its periphery circuits of an image forming apparatus in this embodiment of the present invention.

First, the configurations of these devices will be described.

The image forming apparatus according to this embodiment includes a fixing device 1, an IH (Induction Heating) board (IH circuit) 2, and a host side control circuit 3. The fixing device 1 includes a heating roller 4 and a pressing roller 5. A sheet is sandwiched between them to be fed, thereby fixing a developer having been prepared on the sheet, such as a toner, to the sheet using heat and pressure. The IH (Induction Heating) circuit (IH board) 2 is for supplying a high-frequency current to coils 6, 7*a* and 7*b* inside the heating roller 4 based on a control signal from the host side control circuit 3. The host side control circuit 3 is for maintaining the surface temperature of the heating roller 4 at a predetermined value by performing the feedback of the surface temperature of the heating roller 4, which is detected by thermistors 11 and 12, to the IH board 2. This operation will next be described in more detail.

The fixing device 1 includes the heating roller 4 of a magnetic material in the shape of a roller, which is the object of the induction-heating. Inside the heating roller 4, three coils are arranged along the central axis of the heating roller 4 at predetermined intervals. The three coils are the center coil 6 provided to the central portion, and the side coils 7*a* and 7*b* provided at both sides thereof. The reason for providing the side coils 7*a* and 7*b* is that if the heating roller 4 is heated by only the center coil 6, the temperature rise rate at the end portions thereof is insufficient. By the use of the side coils 7*a* and 7*b*, the insufficiency in the temperature rise rate is compensated for.

Figure 2:
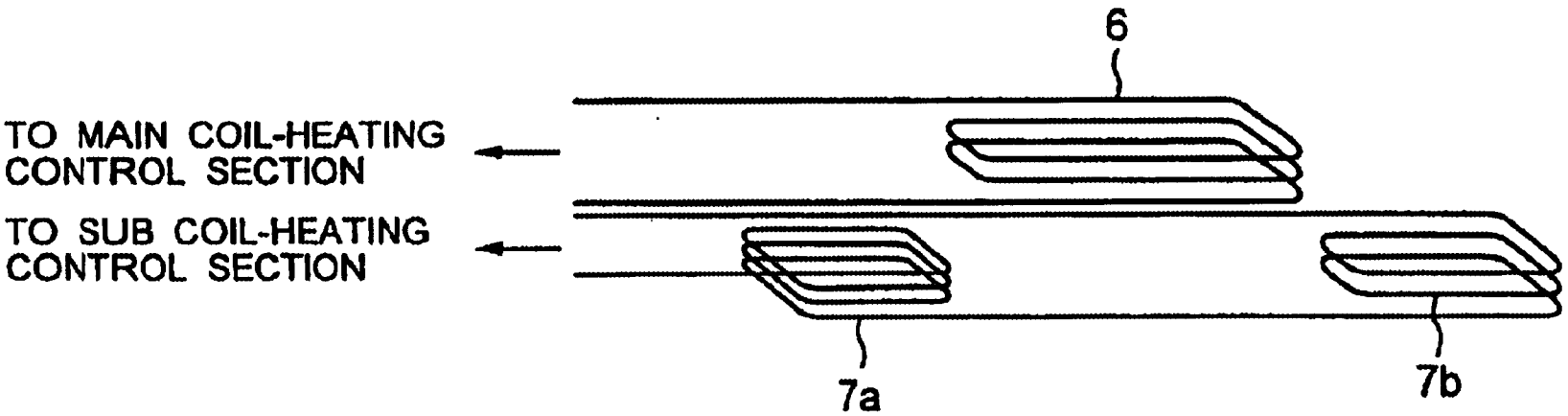
FIG. 2 shows the perspective view of a center coil and side coils.

FIG. 2 is a perspective view showing the center coil 6 and the side coils 7*a* and 7*b*, in which the positions of the coils are vertically shifted. As shown in FIGS. 1 and 2, the center coil 6 and the side coils 7*a* and 7*b* are connected to a main coil-heating control section 9 and a sub coil-heating control section 10 for generating and supplying a high-frequency current based on a current supplied from a smoothing section 8.

A center thermistor 11 for detecting the surface temperature of the central portion of the heating roller 4 corresponding to the center coil 6 is provided on the surface of the heating roller 4 so as to contact it. Furthermore, a side thermistor 12 for detecting the surface temperature of the end portion of the heating roller 4 corresponding to the side coil 7*a* is provided on the surface of the heating roller 4 so as to contact it. The center thermistor 11 and the side thermistor 12 are connected to a host CPU 13 for managing the entire fixing control via an A/D input section 14. Moreover, the center thermistor 11 and the side thermistor 12 are connected to a main comparator section (main COMP section) 15 and a sub comparator section (sub COMP section) 16, which will be described later.

The host CPU 13 is adjusted to calculate IH output (power) values, which are the output of the main and sub coil-heating control section 8 and 9, based on the detected voltages of the center thermistor 11 and the side thermistor 12. Furthermore, the host CPU 13 is adjusted to send the IH output values as power-setting signals to an IH control section 18 via an I/O port 19. More specifically, the host CPU 13 is adjusted to transmit the power-setting signals with respect to the center coil 6 from the I/O port 19 to the IH control section 18 via three main coil power-switching lines. Similarly, the host CPU 13 is adjusted to send the power-setting signals with respect to the side coils 7*a* and 7*b* from the I/O port 19 to the IH control section 18 via three sub coil power-switching lines. On receiving the above-described power setting signals, the IH control section 18 controls the main and sub coil-heating control sections 8 and 9 such that the outputs thereof are equivalent to the above-described IH output values indicated by the above-described power-setting signals.

The main COMP section 15 and the sub COMP section 16 are connected to the CPU 13 via a D/A output section 17 so that a temperature-setting reference voltage is applied thereto from the CPU 13 via the D/A output section 17. The main COMP section 15 and the sub COMP section 16 are adjusted to compare the above-described temperature-setting reference voltage with the voltages detected by the thermistors 11 and 12, and to send the comparison results as thermal monitor ON/OFF signals for turning ON/OFF the oscillation of the center coil 6 and the side coils 7*a* and 7*b*. That is, the main COMP section 15 is adjusted to output an ON signal to oscillate the center coil 6 if the temperature detected by the thermistor 11 is lower than the reference temperature. On the contrary, the main COMP section 15 is adjusted to output an OFF signal to stop the oscillation of the center coil 6 if the temperature detected by the center thermistor 11 is higher than the reference temperature. Similarly, the sub COMP section 16 is adjusted to output an ON signal to oscillate the side coils 7*a* and 7*b* if the temperature detected by the side thermistor 12 is lower than the reference temperature. On the contrary, the sub COMP section 16 is adjusted to output an OFF signal to stop the oscillation of the side coils 7*a* and 7*b* if the temperature detected by the side thermistor 12 is higher than the reference temperature.

A center valve 21 and a side valve 22, such as thermostat, thermal fuse, etc., for preventing the overheating of the heating roller 4 are provided near the surface of the heating roller 4 so as to correspond to the central portion of the center coil 6 and the central portion of the side coil 7*b*. The center valve 21 and the side valve 22 are adjusted to interrupt the alternate power supplied to the IH board 2 and the host side control circuit 3 via an AC plug 23 when the temperature of the heating roller 4 reaches a predetermined value (abnormal temperature). The host side control circuit 3 is supplied with power from a main power supply section 24, which is adjusted to supply power from the AC plug 23 connected thereto via a switch 25.

The operation of the present invention with the above-described structure will next be described.

The operation of switching on the image forming apparatus so as to bring the heating roller 4 into the printable state will first be described. In order to bring the heating roller 4 into the printable state, the heating roller 4 is first heated until the temperature thereof reaches a toner-fixable temperature. After the temperature of the heating roller 4 reaches the toner-fixable temperature, the temperature is maintained, thereby bringing the heating roller 4 into the printable state. More specifically, the following operation is carried out.

First, the IH control section 18 is turned ON to drive the main coil-heating control section 9 and the sub coil-heating control section 10, thereby oscillating the center coil 6 and side coils 7*a* and 7*b*. When the center coil 6 and the side coils 7*a* and 7*b* are oscillated, the heating roller is heated by induction heating. The IH control section 18 controls the IH output at the time of heating operation so as to be equivalent to the power value indicated by the power-setting signal sent from the host CPU 13 to the IH control section 18 via the I/O port 19. Generally, the power value is from a few hundred W to a few thousand W, and generally, the oscillating frequency is from 20 kHz to a few hundred kHz. As previously mentioned, the heating roller 4 is continuously heated until the temperature thereof reaches the toner-fixable temperature, and more specifically, the oscillating state is maintained until the temperature-setting reference voltage serving as the output of the D/A output section 17 and the voltages detected by the center thermistor 11 and the side thermistor 12 coincide with each other. In this embodiment, the center coil 6 and the side coils 7*a* and 7*b* are adjusted not to oscillate at the same time in order to avoid the energy loss generated in the spaces between the coils, and to prevent the power from exceeding a predetermined value. However, the present invention can be applied to the case where these coils are oscillated at the same time. When the temperature-setting reference voltage and the detected voltages coincide with each other, the thermal monitor ON/OFF signal inputted from the main and sub COMP sections 15 and 16 to the IH control section 18 is turned off, thereby stopping the oscillation of the coils caused by the main and sub coil-heating control sections 8 and 9, resulting in the gradual decrease in surface temperature of the heating roller 4. When the surface temperature goes below the hysteresis value, the thermal monitor ON/OFF signal is turned on to restart the oscillation, thereby heating up the heating roller 4. Thus, the heating roller 4 is brought into the printable state by heating up the heating roller 4 until it reaches the fixable temperature, and by maintaining the fixable temperature.

In this embodiment, the spaces between the coils are adjusted such that the surface temperatures of the portions of the heating roller corresponding to the spaces between the center coil 6 and the side coils 7*a* and 7*b* are not higher than the surface temperatures of the portions of the heating roller corresponding to the central portions of the center coil 6 and the side coils 7*a* and 7*b*. This will next be described in detail.

Figure 3:
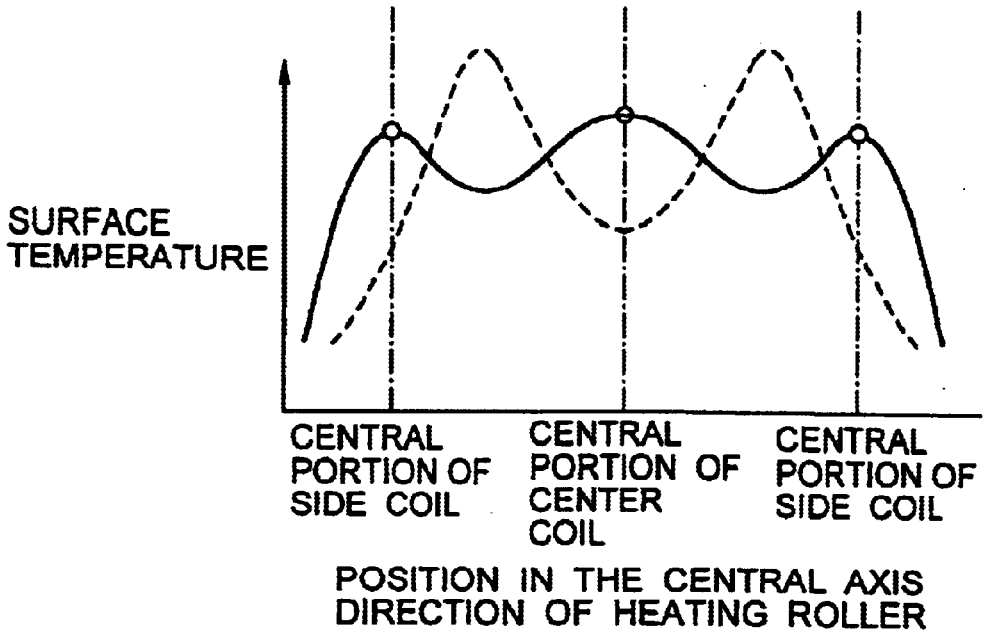
FIG. 3 is a graph showing an example of the relationship between the position in the central axis direction on the surface of the heating roller and the surface temperature of the heating roller.

In order to study the surface temperature distribution of the heating roller, the present inventor drove the center coil and the side coils provided at both the sides thereof with the spaces therebetween being changed. The coils were driven in such ways that the center coil and the side coils at both the sides thereof were simultaneously driven, that the coils were alternately driven, and that only one of them was driven. As a result of this experiment, the present inventor understood that the surface temperature distribution of the heating roller could be changed by adjusting the spaces between the coils. FIG. 3 shows the surface temperature distribution of the heating roller. The dotted line shows the case where the coils are alternately driven and the peak portions come to the portions of the heating roller corresponding to the spaces between the coils. In this case, the spaces between the coils are rather narrow. The solid line shows the case where the coils are either alternately or simultaneously driven and the peak portions come to the portions of the heating roller corresponding to the central portions of the coils. In such a case, the spaces between the coils are wider than those in the former case. Although it is not shown in the graph of FIG. 3, it is clear that if any one of the center coil and the side coils is driven, the peak comes to the central portion of the excited coil regardless of the width of the spaces between these coils.

As can be understood from the above results, if the coils, which are arranged as in the case of the dotted line in the graph, are driven, it may happen that the peak portions may be placed not only on the spaces between the coils but also on the central portions of the coils. Because of this, in order to surely monitor the heating roller, it would be necessary to provide overheating prevention devices not only for spaces between these coils but also for the central portions of the coils. However, if the coils, which are arranged like the case of the solid line in the graph, are driven, the surface temperatures of the portions of the heating roller corresponding to the spaces between the coils do not exceed the surface temperatures of the portions of the heating roller corresponding to the central portions of the coils. Accordingly, it is possible to surely monitor the heating roller with the overheating prevention devices being provided so as to correspond only to the central portions of the coils.

Figure 4:
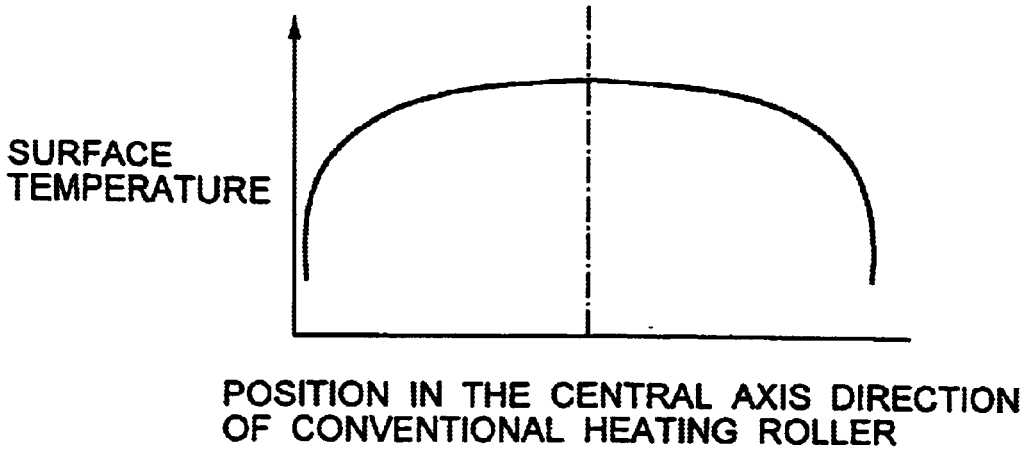
FIG. 4 Prior Art
FIG. 4 is a graph showing the relationship as shown in FIG. 3 with respect to a conventional heating roller.

For these reasons, in this embodiment, the spaces between the coils are adjusted so that the surface temperatures of the portions of the heating roller above the spaces between the coils are not higher than the surface temperatures of the portions of the heating roller above the central portions of the coils. FIG. 4 is the surface temperature distribution of a conventional heating roller including only one coil, which is shown for reference purposes.

Here, one example of the way of adjusting the surface temperature of the heating roller so that the surface temperatures of the portions of the heating roller corresponding to the spaces between the coils are not higher than the surface temperatures of the portions of the heating roller corresponding to the central portions of the coils in the warming-up mode, the ready mode, the printing mode etc., i.e., in every mode, will be described.

First, in the warming-up mode, in order to prevent the temperature at the end portions of the heating roller from being lower, the heating roller is heated by the use of the center coil and the side coils at both the sides thereof. The case where the center coil and the side coils are simultaneously oscillated and the case where the center coil and the side coils are alternately oscillated are considered.

In the former case, the magnetic fields are set off in the spaces between the coils, thereby causing the loss. Accordingly, the rise in temperature at the portions of the heating roller corresponding to the spaces between the coils is lower than the rise in temperature at the portions of the heating roller corresponding to the central portions of the coils. Therefore, no problem arises since the temperatures at the portions of the heating roller corresponding to the spaces between the coils are never higher than the temperatures at the portion of the heating roller corresponding to the central portions of the coils. If the magnetic field is not sufficiently compensated, thereby causing a problem, the positions of the coils are adjusted to become wider, thereby decreasing the rise in temperature.

In the latter case, it can be expected that in the spaces between the coils, oscillations continue. Accordingly, if each space between the coils is narrowed to less than 10 mm, the rise in temperature at the portions of the heating roller corresponding to the spaces between the coils become greater than the rise in temperature at the portions of the heating roller corresponding to the central portions of the coils. In order to avoid this, the spaces between the coils should be adjusted to become wider. In this embodiment, the spaces between the coils are set in the range of from 10 mm to 20 mm. If the spaces are too wide, e.g., more than 20 mm, the difference in temperature between the portions of the heating roller corresponding to the spaces between the coils and the portions of the heating roller corresponding to the central portions of the coils becomes too large, which is not desirable. Thereafter, the spaces between the coils in the latter case and the spaces between the coils in the former case are compared, and the larger space value is employed.

The position of the coils is adjusted in the same manner in the ready mode and the printing mode, thereby specifying the spaces between the coils. In each case, the larger space value is employed. Thus, in every mode, the surface temperatures of the portions of the heating roller corresponding to the spaces between the coils are never higher than the surface temperatures of the heating roller corresponding to the central portions of the coils.

As described above, according to the present invention, the spaces between a plurality of coils are adjusted so that the surface temperatures of the portions of the fixing roller corresponding to the spaces between the coils are never higher than the surface temperatures of the portions of the fixing roller corresponding to the central portions of the coils. Accordingly, it is possible to monitor the surface temperature of the fixing roller with a small number of overheating prevention devices.

What is claimed is:

1. An image forming apparatus comprising:

a pressing roller for pressing a sheet at the time of a fixing operation;

a fixing roller having a hollow portion, facing said pressing roller, rising in temperature by being heated, and fixing a developer to the sheet by sandwiching the sheet between said fixing roller and said pressing roller;

induction heating coils including a center-section coil and an end-section coil, and arranged inside said fixing roller in an axial direction so as to leave a space between the center-section coil and the end-section coil, the space being adjusted so that the temperature of one surface of said fixing roller, said one surface opposing the space, is not higher than the temperatures of the other surface of said fixing roller, said other surface opposing central portions of the coils; and overheating prevention devices for monitoring an abnormally overheated condition of said fixing roller, and for breaking a circuit with said fixing roller so as to turn-off power applied to the two coils at the time of the occurrence of the abnormally overheated condition in which the temperature of the one surface of said fixing roller is more than a predetermined temperature, said overheating prevention devices being provided so as to oppose the center-section coil and the end-section coil, but not to oppose the space between the center- and end-section coils.

2. The image forming apparatus according to claim 1, wherein either the center-section coil and the end-section coil are simultaneously or alternately turned on and heated, or only one of them is turned on and heated.

3. The image forming apparatus according to claim 2, which is capable of selecting the case where either of the center-section coil or the end-section coil is continuously heated and the case where both of the center-section coil and the end-section coil are heated at a constant duty ratio, in a warming-up mode, a standby/idle mode, and a printing mode.

4. The image forming apparatus according to claim 1, further comprising a heating control section for independently controlling the turn-on or turn off of the power to the center-section coil and the end-section coil.

5. The image forming apparatus according to claim 4, wherein said heating control section includes a main coil heating control section for controlling the turn-on or turn-off of the power to the center-section coil, and a sub coil heating control section for controlling the turn-on or turn-off of the power to the end-section coil.

6. The image forming apparatus according to claim 4, further comprising:

temperature monitor detecting the surface temperature of said fixing roller being heated by the center-section coil and the end-section coil; and switch controller controlling said heating control section based on an output from said temperature monitor such that the temperature of said fixing roller becomes suitable for carrying out a fixing operation by simultaneously or alternately turning on the center-section coil and the end-section coil.

7. The image forming apparatus according to claim 6, wherein said temperature monitor is a first thermistor for detecting the surface temperature of the central portion of said fixing roller and a second thermistor for detecting the surface temperature of one end portion of said fixing roller.

8. The image forming apparatus according to claim 7, wherein the heating control of the center-section coil is performed based on an output of the first thermistor, and the heating control of the end-section coil is performed based on an output of the second thermistor.

9. The image forming apparatus according to claim 1, wherein said overheating prevention devices are thermostats or thermal fuses for automatically breaking the circuit at the time of an abnormal overheating condition.

10. The image forming apparatus according to claim 1, wherein the end-section coil comprises a first coil and a second coil, which are provided at one end and the other end of the center-section coil, respectively.

11. The image forming apparatus according to claim 10, wherein said first coil and said second coil are connected in series.

12. The image forming apparatus according to claim 1, wherein the distance of the center-section coil and the end-section coil is 10 to 20 mm.

13. An image forming apparatus comprising:

a pressing roller for pressing a sheet at the time of a fixing operation;

a fixing roller having a hollow portion, facing said pressing roller, rising in temperature by being heated, and fixing a developer to the sheet by sandwiching the sheet between said fixing roller and said pressing roller;

induction heating coils including a center-section coil and an end-section coil, and arranged inside said fixing roller in an axial direction so as to leave a space between the center-section coil and the end-section coil, the space being adjusted so that the surface temperature of one surface of said fixing roller, said one surface opposing the space, is not higher than the temperatures of the other surface of said fixing roller, said other surface opposing central portions of the coils in the case where either of the center-section coil or the end-section coil is continuously heated and in the case where both of the center-section coil and the end-section coil are heated at a constant duty ratio, in a warming-up mode, a standby/idle mode, and a printing mode;

a first thermistor for detecting the surface temperature of the central portion of said fixing roller;

a second thermistor for detecting the surface temperature of the end portion of said fixing roller;

a heating control section for controlling turn-on or turn-off of power applied to the center-section coil and the end-section coil based on outputs of the first thermistor and the second thermistor; and overheating prevention devices for monitoring an abnormally overheated condition of said fixing roller, and for breaking a circuit with said fixing roller so as to turn-off the power to the two coils at the time of the occurrence of the abnormally overheated condition in which the temperature of the one surface of said fixing roller is more than a predetermined temperature, said overheating prevention devices being provided so as to oppose central portions of the center-section coil and the end-section coil, but not to oppose the space between the center- and end-section coils.

14. The image forming apparatus according to claim 13, wherein the distance of the center-section coil and the end-section coil is 10 to 20 mm.

15. A method of forming an image with an image forming apparatus, comprising:

sandwiching a sheet between a fixing roller and a pressing roller;

induction heating the fixing roller with a center-section coil and an end-section coil, said center-section coil and said end-section coil being alternately turned on, the center-section coil and the end-section coil being arranged inside the fixing roller in an axial direction so as to leave a space between the center-section coil and the end-section coil; and turning off power applied to the coils when an overheated condition occurs in which the temperature of a first surface of the fixing roller opposing the space is more than a predetermined temperature, wherein the space is configured such that the temperature of the first surface of the fixing roller opposing the space is not higher than the temperature of a second surface that opposes central portions of the coils.

16. An image forming apparatus comprising:

means for sandwiching a sheet between a fixing roller and a pressing roller;

means for induction heating the fixing roller; and means for turning off power applied to the coils when an overheated condition occurs in which the temperature of a first surface of the fixing roller is more than a predetermined temperature, wherein the means for induction heating includes a center-section coil and an end-section coil, said center-section coil and said end-section coil being alternately turned on, and wherein the means for induction heating is arranged inside the fixing roller in an axial direction so as to leave a space between the center-section coil and the end-section coil.

17. The image forming apparatus according to claim 16, wherein the space is configured such that the temperature of the first surface of the fixing roller is not higher than the temperature of a second surface that-opposes central portions of the coils.

18. An image forming apparatus comprising:

a pressing roller which presses a sheet at the time of a fixing operation;

a fixing roller which has a hollow portion, faces said pressing roller, rises in temperature by being heated, and fixes a developer to the sheet by sandwiching the sheet between said fixing roller and said pressing roller;

induction heating coils which includes a center-section coil and an end-section coil, said center-section coil and said end-section coil being alternately turned on, and arranged inside said fixing roller in an axial direction so as to leave a space between the center-section coil and the end-section coil, the space being adjusted so that the temperature of one surface of said fixing roller, said one surface opposing the space, is not higher than the temperatures of the other surface of said fixing roller, said other surface opposing central portions of the coils; and overheating prevention devices which monitor an abnormally overheated condition of said fixing roller, and which break a circuit with said fixing roller so as to turn-off power applied to the two coils at the time of the occurrence of the abnormally overheated condition in which the temperature of the one surface of said fixing roller is more than a predetermined temperature, said overheating prevention devices being provided so as to oppose the center-section coil and the end-section coil, but not to oppose the space between the center- and end-section coils.

19. The image forming apparatus according to claim 18, wherein either the center-section coil and the end-section coil are simultaneously or alternately turned on and heated, or only one of them is turned on and heated.

20. The image forming apparatus according to claim 19, which is capable of selecting the case where either of the center-section coil or the end-section coil is continuously heated and the case where both of the center-section coil and the end-section coil are heated at a constant duty ratio, in a warming-up mode, a standby/idle mode, and a printing mode.

21. The image forming apparatus according to claim 18, further comprising a heating control section which independently controls the turn-on or turn off of the power to the center-section coil and the end-section coil.

22. The image forming apparatus according to claim 21, wherein said heating control section includes a main coil heating control section for controlling the turn-on or turn-off of the power to the center-section coil, and a sub coil heating control section for controlling the turn-on or turn-off the power to the end-section coil.

23. The image forming apparatus according to claim 21, further comprising:

temperature monitor which detects the surface temperature of said fixing roller being heated by the center-section coil and the end-section coil; and switch controller which controls said heating control section based on an output from said temperature monitor such that the temperature of said fixing roller becomes suitable for carrying out a fixing operation by simultaneously or alternately turning on the center-section coil and the end-section coil.

24. The image forming apparatus according to claim 23, wherein said temperature monitor is a first thermistor which detects the surface temperature of the central portion of said fixing roller and a second thermistor which detects the surface temperature of one end portion of said fixing roller.

25. The image forming apparatus according to claim 24, wherein the heating control of the center-section coil is performed based on an output of the first thermistor, and the heating control of the end-section coil is performed based on an output of the second thermistor.

26. The image forming apparatus according to claim 18, wherein said overheating prevention devices are thermostats or thermal fuses which automatically break the circuit at the time of an abnormal overheating condition.

27. The image forming apparatus according to claim 18, wherein the end-section coil comprises a first coil and a second coil, which are provided at one end and the other end of the center-section coil, respectively.

28. The image forming apparatus according to claim 27, wherein said first coil and said second coil are connected in series.

29. The image forming apparatus according to claim 18, wherein the distance of the center-section coil and the end-section coil is 10 to 20 mm.

* * * * *